US005752861A

United States Patent [19]

Cherry et al.

[11] Patent Number: 5,752,861

[45] Date of Patent: May 19, 1998

[54] ELECTRICAL WIRE CONNECTOR WITH IMPROVED WEDGE

[75] Inventors: Hitesh Cherry; Michael A. Kandros; Daniel Vincent Nardone, all of Harrisburg, Pa.

[73] Assignee: The Whitaker Corporation, Wilmington, Del.

[21] Appl. No.: 718,036

[22] Filed: Sep. 23, 1996

Related U.S. Application Data

[63] Continuation of Ser. No. 379,804, Jan. 27, 1995, abandoned.

[51] Int. Cl.[6] ..... H01R 4/50

[52] U.S. Cl. ..... 439/783; 403/374

[58] Field of Search ..... 439/783, 790, 439/863; 403/374

[56] References Cited

U.S. PATENT DOCUMENTS

| | | | |
|---|---|---|---|
| 2,106,724 | 2/1938 | Cope | 173/273 |
| 3,065,449 | 11/1962 | Matthysse et al. | 339/247 |
| 3,065,452 | 11/1962 | Osborn | 339/274 |
| 3,155,039 | 11/1964 | Broske | 102/38 |
| 3,280,856 | 10/1966 | Broske et al. | 140/113 |
| 3,349,167 | 10/1967 | Mixon, Jr. et al. | 174/94 |
| 3,462,543 | 8/1969 | Wahl et al. | 439/783 |
| 4,059,333 | 11/1977 | Mixon, Jr. | 339/247 |
| 5,006,081 | 4/1991 | Counsel et al. | 439/783 |
| 5,281,173 | 1/1994 | Cherry et al. | 439/783 |
| 5,340,336 | 8/1994 | Menechella | 439/783 |

FOREIGN PATENT DOCUMENTS 355492 8/1961 Switzerland .

*Primary Examiner*—Neil Abrams
*Assistant Examiner*—Brian J. Biggi
*Attorney, Agent, or Firm*—Mary K. Van Atten

[57] ABSTRACT

A wire connector (10) is disclosed having a clamping member (12) and a mating wedge (14). The clamping member includes two oppositely formed rolled over edges (18, 20) that form two opposing concave channels (22, 24) for receiving a pair of conductors (26, 28) and the wedge for locking the conductors tightly in place. The wedge includes two opposite edges (44, 46) that engage the two conductors when the wedge is in its closed position. A pair of members (64, 66) extend from an end (48) of the wedge and have edges (68, 70) that converge from the edges (44, 46) toward the longitudinal axis 42 of the wedge for engaging and camming the conductors into position within the clamping member during insertion of the wedge. The two members (64, 66) are spaced apart to form a clearance cutout for straddling the jaw of an insertion tool.

13 Claims, 5 Drawing Sheets

ELECTRICAL WIRE CONNECTOR WITH IMPROVED WEDGE

This application is a Continuation of application Ser. No. 08/379,804 filed Jan. 27, 1995, now abandoned.

The present invention relates to wire connectors for electrical distribution systems of the type having an outer clamping member and a wedge for interconnecting two or more conductors.

BACKGROUND OF THE INVENTION

In the power distribution industry wire connectors are widely used to interconnect electrical equipment to power conductors without physically breaking or rerouting the power conductor. The wire connector usually consists of two parts, a C-shaped clamping member and a wedge. Such wire connectors are disclosed in U.S. Pat. No. 3,280,856 which issued Oct. 26, 1966 to Broske et al. and U.S. Pat. No. 3,349,167 which issued Oct. 24, 1967 to Mixon Jr. et al. A typical wire connector of more recent design is disclosed in U.S. Pat. No. 5,281,173 which issued Jan. 25, 1994 to Cherry et al. and which is incorporated herein by reference. The typical wire connector, as disclosed in the '173 patent, includes a clamping member having a pair of opposite rolled over edges forming opposing channels and a wedge that is conformably received within the two channels. The opposing channels are arranged for receiving two conductors such as power cables, wires, or in some cases a tap lug, with the wedge therebetween. The clamping member includes an intermediate or web portion between the two rolled over edges having a bight disposed laterally of the two channels and a double loop, one on each side of the bight. The clamping member is made of a spring material so that the bight and double loop provide resiliency, thereby allowing the two rolled over edges to expand as the wedge and conductors are forced into the channels, and to provide a clamping action against the conductors and wedge. The wedge includes a rounded lead-in portion that provides a smooth camming action against the conductors as the wedge is forced into place within the clamping member by means of a tool. However, the wedge is sometimes difficult to hold in alignment with the axis of the clamping member while operating the tool, due to the curvature of the rounded end. Ideally, the wedge is inserted into the end of the clamping member and manually held in tight engagement with the two conductors, and then is forced into place by the tool, spreading apart the two rolled over edges against the bias of the resilient web. This operation is performed either with a hand tool or a power assisted tool. In either case, an edge of the tool must be hooked onto the edge of the web without overhanging the channel area where it can interfere with the rounded end of the wedge as the wedge is moved into place. This is especially of concern when a power assisted tool is being used, because if the edge of the tool is not properly hooked onto the edge of the web when the insertion tool is triggered, the tool or wire connector can be damaged. Further, the wire connectors described above do not have a positive stop for limiting the depth of insertion of the wedge into the clamping member. This, of course, may adversely affect repeatability and reliability of the connection.

What is needed is a wire connector having a wedge that is easily manually aligned with the clamping member and associated conductors and is easily held in place during operation of the insertion tool. Additionally, the wedge should be structured so that it cannot interfere with the operation of the insertion tool and should have a positive stop to limit depth of insertion into the clamping member.

SUMMARY OF THE INVENTION

An electrical wire connector for electrically connecting two conductors together is disclosed. The wire connector includes a clamp member having a web and two rolled over edges on opposite sides thereof forming inwardly facing opposed first and second concave channels, respectively. The web is resiliently biased so that the two channels are urged toward each other. A wedge is provided having a longitudinal axis, first and second opposite edges on opposite sides of the axis substantially parallel therewith and terminating at an end of the wedge. The wedge is conformably received in a closed position between the first and second channels of the clamping member where the first opposite edge is in opposed relationship with the first channel for receiving and clamping a conductor therebetween and the second opposite edge is in opposed relationship with the second channel for receiving and clamping another conductor therebetween. The wedge includes first and second mutually spaced apart members extending from the end. The first member has a first lead-in surface converging from the first opposite edge linearly toward the axis while the second member has a second lead-in surface converging from the second opposite edge linearly toward the axis. The wires connector is arranged so that when moving the wedge into the closed position within the clamping member, the first and second members cam the conductor and the other conductor into respective channels of the clamping member and force the first and second channels apart against the urging of the resiliently biased web until the first and second edges of the wedge enter the channels.

DESCRIPTION OF THE PREFERRED EMBODIMENT

Figure 1:
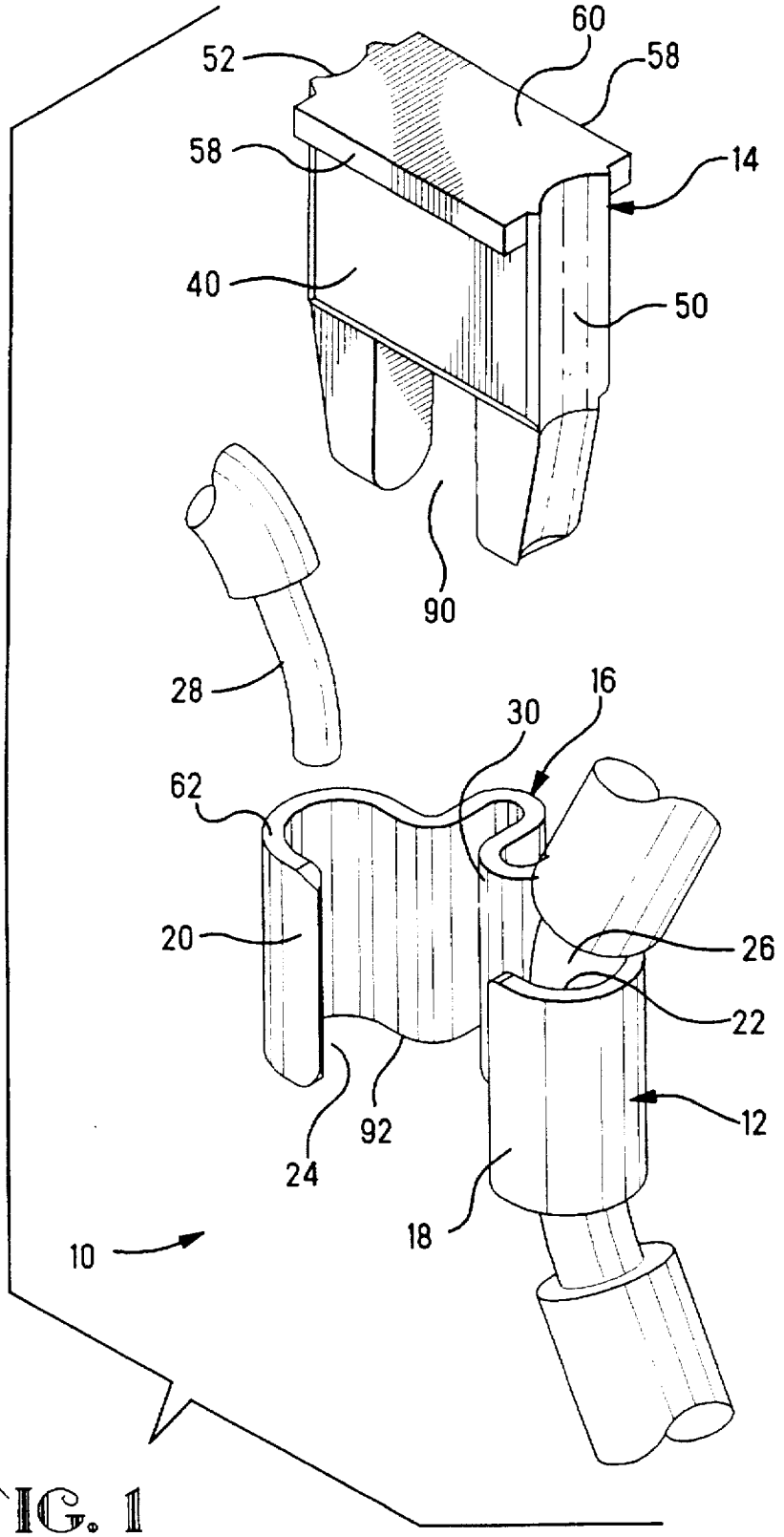
FIG. 1 is an exploded parts view of a wire connector incorporating the teachings of the present invention.
Figure 2:
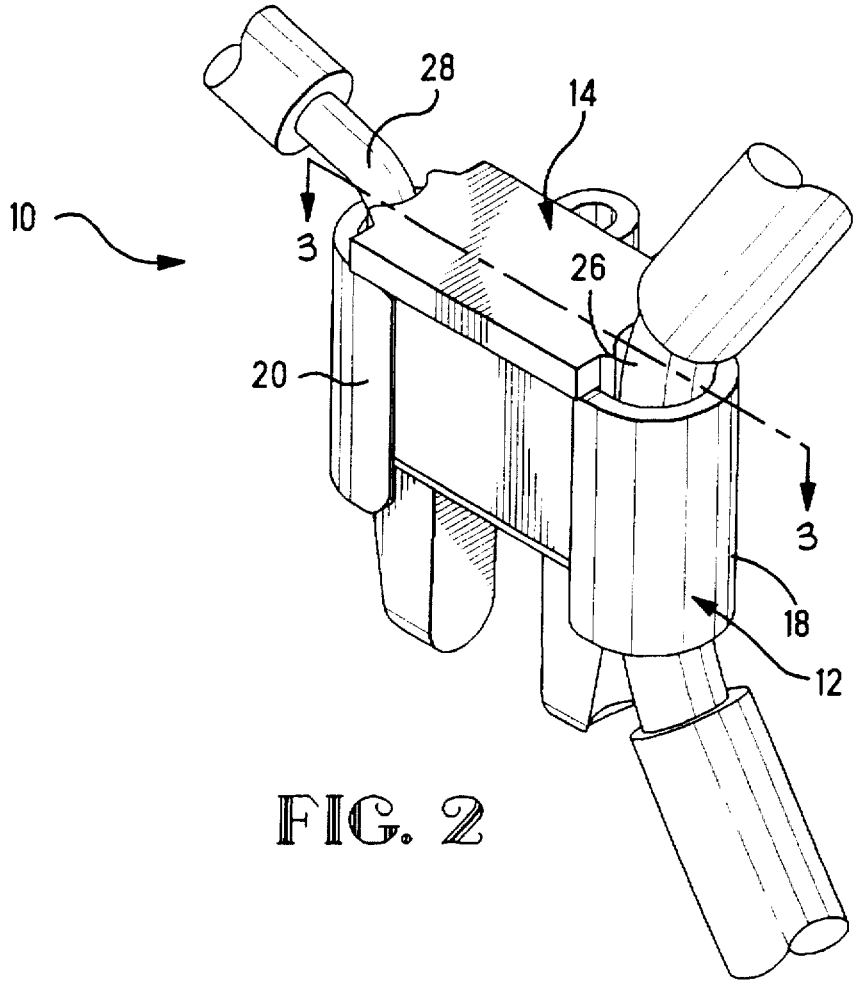
FIG. 2 is a isometric view of the assembled connector shown in FIG. 1.
Figure 3:
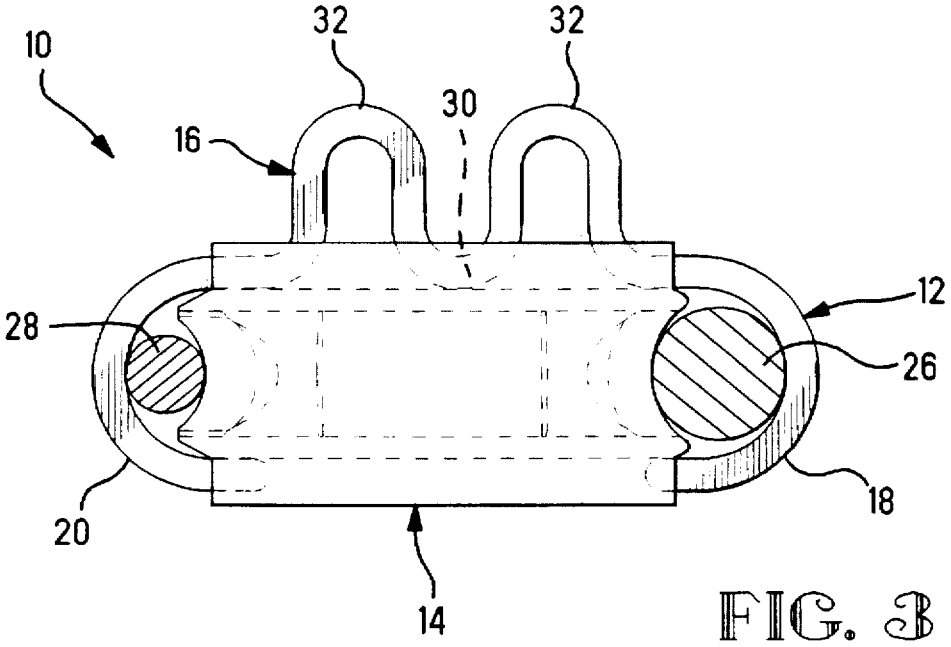
FIG. 3 is a cross-sectional view taken along the lines 3—3 in FIG. 2.

There is shown in FIGS. 1, 2, and 3, a wire connector 10 having a clamping member 12 and a wedge 14. The clamping member is of the type shown in the above mentioned '173 patent, and includes a web portion 16 and two oppositely formed rolled over edges 18 and 20. The two rolled over edges 18 and 20 form opposing channels 22 and 24 for receiving conductors 26 and 28, respectively, therein. The web 16 includes a bight portion 30 disposed intermediate the two rolled over edges and two loops 32, one on each side of the bight. The clamping member is made of any suitable spring material, such as high tempered aluminum, so that the bight and two loops form a resilient structure that will allow the two rolled over edges to be forced apart somewhat by the wedge 14, and yet provide a predictable clamping force on the two conductors 26 and 28 within the channels 22 and 24, respectively.

Figure 4A:
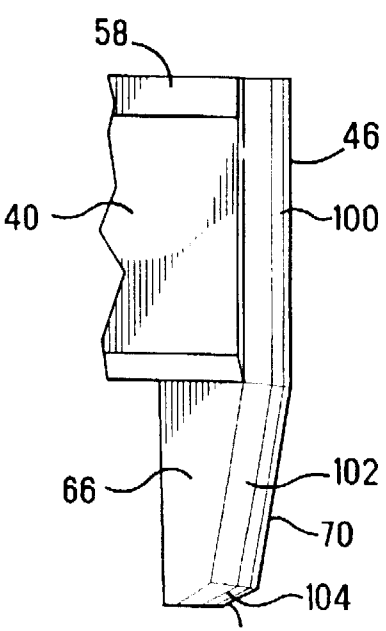
FIGS. 4A and 5A are front and bottom partial views of the wedge shown in FIGS. 4 and 5, respectively, showing an alternative embodiment.
Figure 5A:
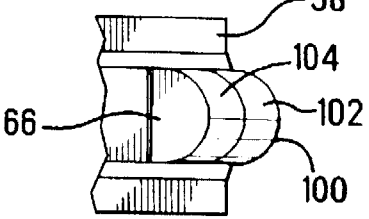
Figure 4:
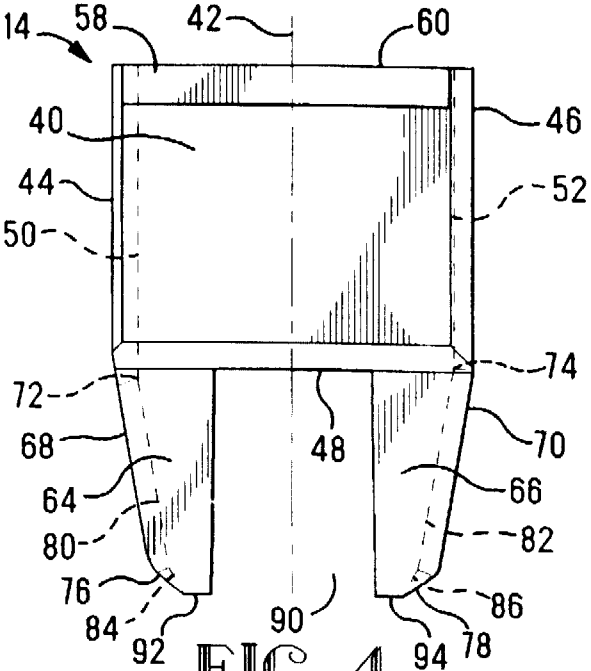
FIGS. 4, 5, and 6 are front, bottom, and side views, respectively, of the wedge shown in FIG. 1.
Figure 5:
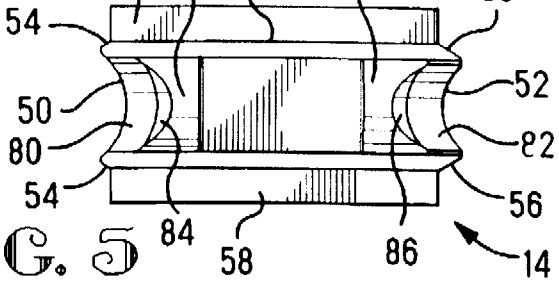
Figure 6:
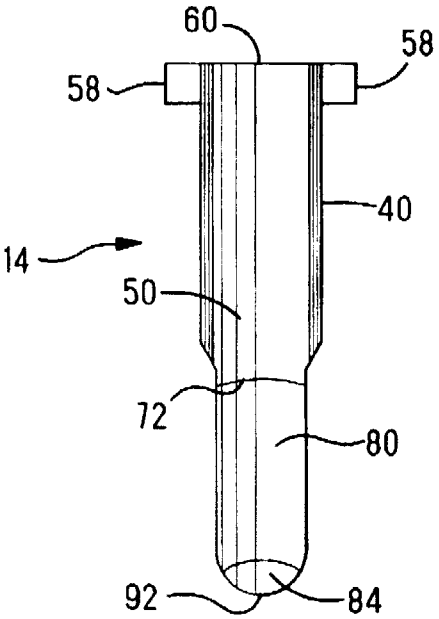

The wedge 14, as best seen in FIGS. 4, 5, and 6, includes a body 40 of generally rectangularly shape having a longitudinal axis 42. The body includes a pair of opposite edges 44 and 46 that are substantially parallel to the axis 42 and terminate at an end 48, as shown in FIG. 4. The two opposite edges 44 and 46 have concave surfaces 50 and 52 that conform somewhat to the diameters of the two conductors 26 and 28, respectively. In the present example, the diameter of the conductor 28 is smaller than the diameter of the conductor 26 and, therefore, the radius of the concave surface 52 is less than the radius of the concave surface 50. However, these two radiuses may be identical where the diameters of the two conductors are identical. The edges 44 and 46 are chamfered on both sides, as shown at 54 and 56, respectively, to allow sufficient clearance with the walls of the channels 22 and 24, respectively, as best seen in FIG. 3. A pair of flanges 58 extend outwardly from opposite side of the body, opposite the end 48, as shows in FIGS. 4, 5, and 6. The body 40 and the two flanges form a flush top surface 60 that is intersected by the two concave surfaces 50 and 52, as best seen in FIG. 1. The flanges 58 abut a top surface 62 of the clamping member 12 when the wedge is fully inserted, as shown in FIG. 2. First and second spaced apart members 64 and 66, respectively, extend from the end 48 of the body 40, as shown in FIGS. 4, 5, and 6. The members 64 and 66 have first edges 68 and 70, respectively, that begin flush with the edges 44 and 46, as indicated at 72 and 74, respectively, near the end 48, and converge toward the axis 42 away from the end 48 and terminate at second edges 76 and 78, respectively, as best seen in FIG. 4. The two second edges 76 and 78 extend further away from the end 48 and converge more steeply toward the axis 42 than do the first edges. The first edges 68 and 70 are linear, that is straight, as viewed in FIG. 4, include concave surfaces 80 and 82, respectively, that merge with and blend into respective concave surfaces 50 and 52, as shown at 72 and 74. Additionally, the second edges 76 and 78 include concave surfaces 84 and 86 that merge with and blend into respective concave surfaces 80 and 82, and terminate at respective free ends 92 and 94. The concave surfaces 50, 80, and 84 are relatively smooth and similar in curvature, as are the concave surfaces 52, 82, and 86. The two members 64 and 66 are spaced apart to form an opening 90 for providing clearance with the jaw of the insertion tool, as will be explained below.

An alternative embodiment of the wedge 14 is shown in FIGS. 4A and 5A. All of the structural elements of the wedge are identical except that the concave surfaces 52, 82, and 78 are convex surfaces 100, 102, and 104, respectively. This structure is beneficial when the conductor 28 is terminated to a tap lug, not shown, and the tap lug is bolted directly to the wedge or to an extension of the wedge. The convex surfaces 100 and 102 then engage the walls of the channel 24 in a similar fashion and with a similar result as when the concave surfaces 52 and 82 force the conductor 28 into the channel 24, as described above.

Figure 7:
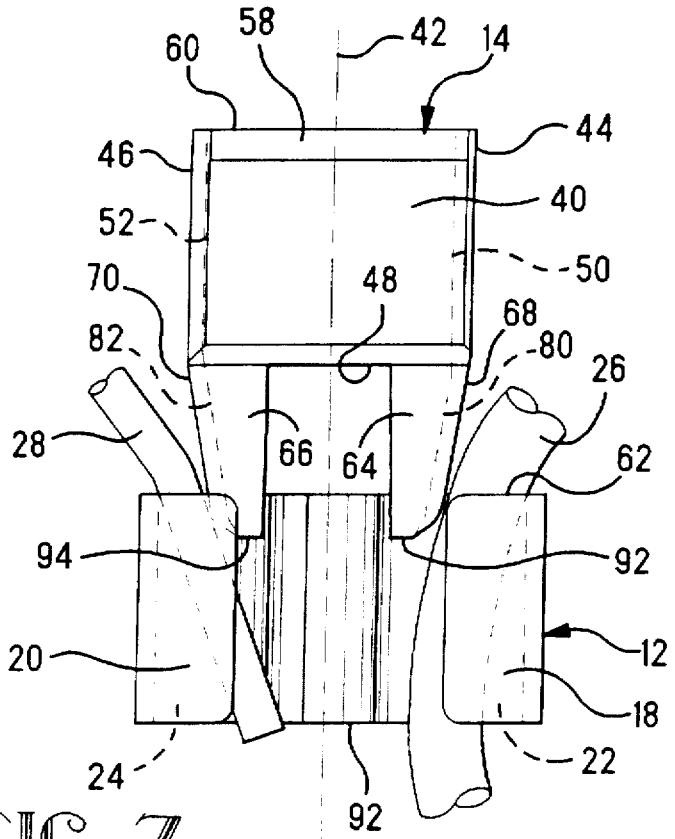
FIGS. 7, 8, and 9 are front views showing various positions of the wedge with respect to the clamping member during insertion of the wedge.
Figure 8:
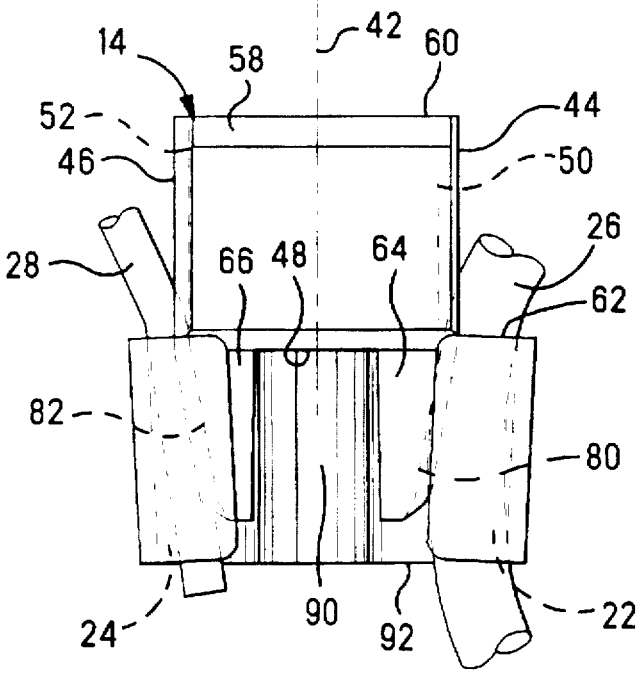
Figure 9:
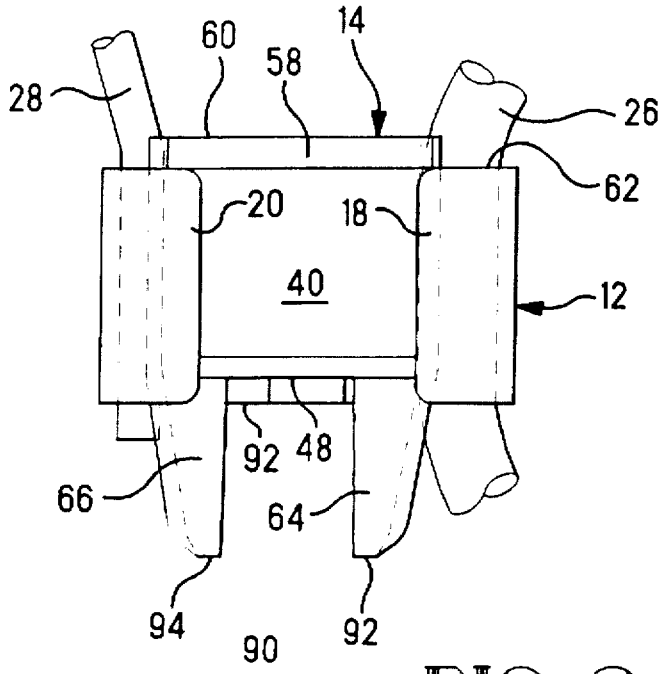

In operation, as shown in FIG. 7, the conductors 26 and 28 are arranged within their respective channels 22 and 24 of the clamping member 12. The wedge 14 is aligned with the clamping member so that the axis 42 of the wedge is perpendicular to the top surface 62 of the clamping member and substantially central to the two channels 22 and 24. The ends 92 and 94 of the two members 64 and 66 are inserted into their respective channels 22 and 24 so that the concave surfaces 80 and 82 engage the conductors 26 and 28, respectively. At this point the wedge is easily held relatively stable, in alignment with the clamping member, because the linear concave surfaces 80 and 82 engage the conductors along a substantial portion of their lengths. As insertion of the wedge continues, the rolled over edges 18 and 20, near the top surface 62, are cammed outwardly, against the biasing of the resilient web portion 16, away from the axis 42 by the action of the wedge being force further into the clamping member 12, as shown in FIG. 8. This camming action is facilitated by the smooth concave surfaces 80, 82, 50, and 52 sliding along the surfaces of the conductors 26 and 28 and forcing them further into the channels as the wedge moves with respect to the clamping member. As movement of the wedge continues, the rolled over edges 18 and 20 are forced outwardly until they are again substantially parallel and the body 40 of the wedge is fully inserted into the clamping member, as shown in FIG. 9. In this position, the resilient web portion 16 urges the rolled over edges 18 and 20 toward each other so that the two conductors 26 and 28 are securely clamped against the parallel concave surfaces 50 and 52, respectively. Note that the flanges 58 are in abutting engagement with the top surface 62 of the clamping member, and the wedge is in its closed position with respect thereto. Note also that the end 48 of the wedge 14 is above the bottom surface 92 of the clamping member 12. This assures that an insertion tool will not interfere with the movement of the wedge during insertion.

Figure 10:
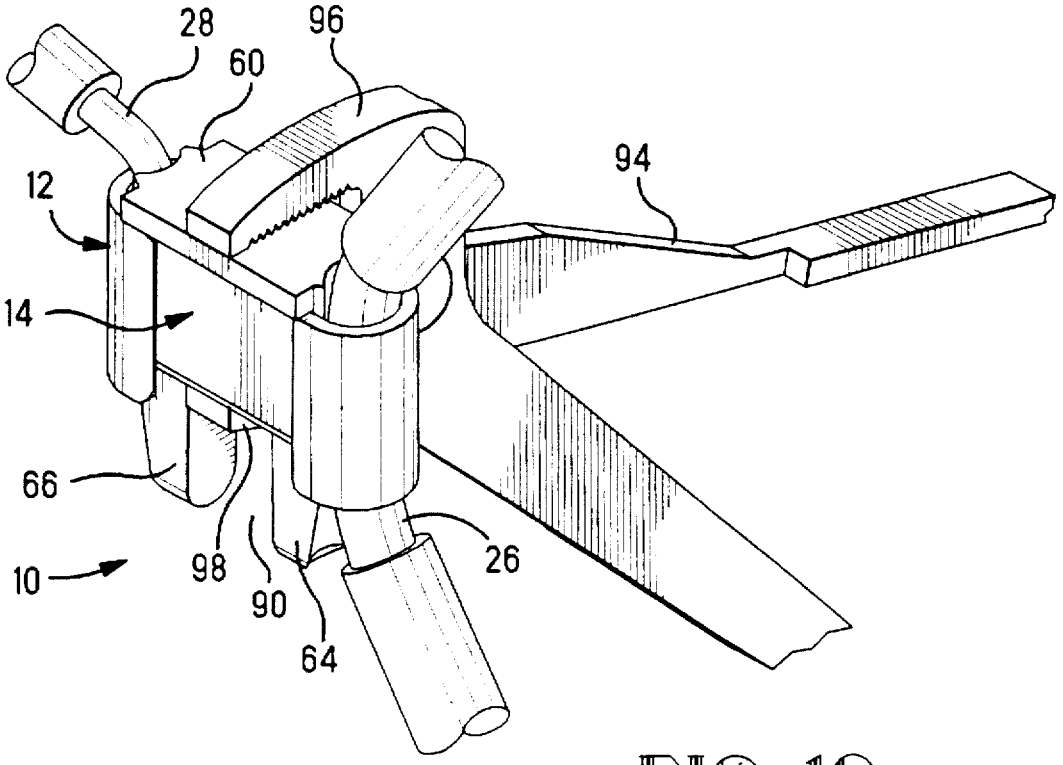
FIG. 10 is an isometric view illustrating the use of pliers for inserting the wedge into the clamping member.

As shown in FIG. 10, the smaller sizes of the present wire connectors may be assembled with the use of pliers 94. The wedge and clamping member are positioned with the conductors 26 and 28 in their respective positions, approximately as shown in FIG. 8. Then the upper jaw 96 of the pliers is placed on the top surface 60 of the wedge and the lower jaw 98 in engagement with the bottom surface 92 of the clamping member. As the pliers are operated the two jaws force the wedge into the clamping member as described above. As the wedge moves toward its closed position, shown in FIG. 9, the two members 64 and 66 exit below the bottom surface 92 and straddle the lower jaw 98, as shown in FIG. 10. This assures that the lower jaw of the pliers does not interfere with movement of the wedge during insertion thereof. For the larger sizes of wire connectors a power assisted tool, not shown, may be utilized instead of the pliers. The power source for such power assisted tools can be hydraulic, electric, or solid propellant, as is well known in the industry. It will be understood that the teachings of the present invention may be advantageously utilized with all such tools, or even without tools.

The use of the term "power cable" and "conductors" herein is intended to include all electrical conductors for interconnecting electrical equipment to electrical power sources, either positive or negative polarity or ground, including cables, wires, and similar structures, of both stranded and solid construction.

An important advantage of the present invention is that the wedge is easily manually aligned with the clamping member and associated conductors and is easily held in place during operation of the insertion tool. Additionally, the wedge is structured so that the jaw of the insertion tool cannot interfere with movement of the wedge during insertion thereof. Further, the wedge includes a positive stop for limiting further inward movement of the wedge once it is fully inserted into the clamping member.

We claim:

1. An electrical wire connector for electrically connecting two conductors together comprising:

(a) a clamp member having a web and two inwardly facing opposed first and second concave channels on opposite sides of said web, said web being resiliently biased so that said two channels are urged toward each other;

(b) a wedge having a main body with first and second opposite edges substantially mutually parallel, said wedge to be conformably received in a closed position between said first and second channels of said clamping member where said first opposite edge is in opposed relationship with said first channel for receiving and clamping a conductor therebetween and said second opposite edge is in opposed relationship with said second channel for receiving and clamping another conductor therebetween, said wedge including first and second mutually spaced apart members being integral with the main body and extending therefrom and having first and second lead-in edges mutually converging from said first and second opposite edges, respectively, in a direction away therefrom, whereby, when moving said wedge into said closed position within said clamping member, said first and second members cam said conductor and said other conductor into respective channels of said clamping member and force said two channels apart against said urging of said resiliently biased web until said first and second opposite edges of said wedge enter said channels.

2. The wire connector according to claim 1 wherein said first opposite edge has a concave surface and said second opposite edge has a convex surface.

3. The wire connector according to claim 1 wherein said first and second opposite edges have first and second concave surfaces, respectively.

4. The wire connector according to claim 3 wherein said first and second lead-in edges have third and fourth concave surfaces that intersect said first and second concave surfaces, respectively.

5. The wire connector according to claim 4 wherein said third and fourth concave surfaces diverge at a specific rate of divergence from said intersection with their respective said first and second concave surfaces and then diverge away therefrom at an increased rate.

6. The wire connector according to claim 5 wherein said spaced apart members form an opening for receiving a jaw of an assembly tool therein with sufficient clearance so that said wedge is free to move into said closed position without interference with said tool.

7. The wire connector according to claim 6 wherein said wedge includes a flange extending therefrom and arranged to abuttingly engage a surface of said clamping member as said wedge is moved toward and into said closed position, thereby inhibiting further said movement when said wedge is in said closed position.

8. An electrical wire connector for electrically connecting two conductors together comprising:

(a) a clamp member having a web and two rolled over edges on opposite sides thereof forming inwardly facing opposed first and second concave channels, said web being resiliently biased so that said two channels are urged toward each other;

(b) a wedge having a main body and a longitudinal axis, first and second opposite edges on opposite sides of said axis substantially parallel therewith and terminating at an end of said wedge, said wedge to be conformably received in a closed position between said first and second channels of said clamping member where said first opposite edge is in opposed relationship with said first channel for receiving and clamping a conductor therebetween and said second opposite edge is in opposed relationship with said second channel for receiving and clamping another conductor therebetween, said wedge including first and second mutually spaced apart members being integral with the main body and extending from the main body and from said end, said first member having a first lead-in edge converging from said first opposite edge linearly toward said axis and said second member having a second lead-in edge converging from said second opposite edge linearly toward said axis, whereby, when moving said wedge into said closed position within said clamping member, said first and second members cam said conductor and said other conductor into respective channels of said clamping member and force said two rolled over edges apart against said urging of said resiliently biased web until said first and second edges of said wedge enter said channels.

9. The wire connector according to claim 8 wherein said first and second opposite edges have first and second concave surfaces, respectively.

10. The wire connector according to claim 9 wherein said first and second lead-in edges have third and fourth concave surfaces that intersect said first and second concave surfaces, respectively, at said end.

11. The wire connector according to claim 10 wherein said third and fourth concave surfaces diverge from said second end at a specific angle to said axis and toward said axis, and then diverge toward said axis at an increased angle.

12. The wire connector according to claim 11 wherein said spaced apart members form an opening for receiving a jaw of an assembly tool therein with sufficient clearance so that said wedge is free to move into said closed position without interference with said tool.

13. The wire connector according to claim 12 wherein said wedge includes a flange extending therefrom and arranged to abuttingly engage a surface of said clamping member as said wedge is moved toward and into said closed position, thereby inhibiting further said movement when said wedge is in said closed position.

* * * * *